United States Patent [19]

Armstrong

[11] 4,105,074

[45] Aug. 8, 1978

[54] CEMENTING STAGING TOOL

[76] Inventor: Ernest E. Armstrong, 3521 Seaboard, Midland, Tex. 79701

[21] Appl. No.: 714,589

[22] Filed: Aug. 16, 1976

[51] Int. Cl.[2] ..... E21B 33/14

[52] U.S. Cl. ..... 166/317; 166/330; 166/334

[58] Field of Search ..... 166/330, 332, 334, 237, 166/317

[56] References Cited

U.S. PATENT DOCUMENTS

| | | | |
|---|---|---|---|
| 2,675,875 | 4/1954 | Potts | 166/334 |
| 3,233,677 | 2/1966 | Myers | 166/334 X |
| 3,661,207 | 5/1972 | Current et al. | 166/317 X |
| 3,736,984 | 6/1973 | Garrett | 166/330 |

*Primary Examiner*—Ernest R. Purser
*Assistant Examiner*—William F. Pate, III
*Attorney, Agent, or Firm*—Marcus L. Bates

[57] ABSTRACT

A cementing staging tool for use downhole in a borehole which is interposed in a casing string and manipulated by longitudinal and rotational movement of the upper casing string. The tool enables cement to be pumped down through the string of casing to form a lower plug. The upper casing string is then rotated and thereafter lowered to thereby open a lateral flow passageway through which cement can be pumped. The cement flows through the tool and fills the borehole annulus, thereby cementing the casing string to the borehole wall. The tool is closed by lowering the upper marginal length of the casing string.

The tool maintains the ends of the casing string in captured relationship respective to one another at all times, and is left downhole as a permanent part of the casing string after the cementing operation has been completed.

18 Claims, 14 Drawing Figures

CEMENTING STAGING TOOL

BACKGROUND OF THE INVENTION

In drilling boreholes for the production of hydrocarbons, it is necessary to install a casing which extends from the surface of the earth to an elevation located downhole in a borehole. The annulus between the borehole wall and the exterior of the casing must be completely filled with cement, thereby preventing communication between various strata through which the borehole extends.

There are cementing tools known to those skilled in the art which can be manipulated to provide bypass from a medial portion of the casing string directly into the borehole annulus. These tools are expensive, complex in design, and often must be drilled after the cementing operation has been completed.

It is therefore desirable to have made available a cementing tool which is simple in design, positive in operation, and which is fabricated in such a way that there is no need to drill a passageway through the interior of the tool after the cementing operation has been completed.

SUMMARY OF THE INVENTION

This invention relates to downhole tools and specifically to a cementing tool which is series connected into a string of casing for enabling cement to be pumped down the string and thereafter laterally through the tool where the cement flows directly into the borehole annulus. The tool is thereafter moved to the closed position by manipulating the upper casing string, and left downhole as a permanent part of the string.

The tool includes a sub by which one end thereof can be connected into the casing string, a sealed, fluid-conducting latch means, a mandrel, and a barrel.

The latch means includes a receptacle which latchably engages a hollow sleeve so that a hollow flow conduit results. The mandrel and sub include opposed marginal ends by which the tool can be connected in series relationship within the string of casing. The barrel includes opposed ends which are connected to the sub and to the mandrel such that the mandrel, barrel, and sub are concentrically arranged respective to one another.

A threaded interior surface is formed within the barrel which cooperates with a similar threaded surface formed on an exterior marginal length of the mandrel, thereby enabling the mandrel to be threadedly disengaged from the barrel.

The sleeve and the receptacle are mounted in spaced relationship adjacent opposed ends of the barrel.

When the barrel is rotated respective to the mandrel, the threads therebetween are disengaged, thereby enabling the mandrel to be telescoped into the barrel to thereby form an annular area between the barrel and the mandrel. The annular area forms the lateral flow passageway from the interior of the tool into the borehole annulus. The mandrel is subsequently telescoped further into the barrel to cause the sleeve and receptacle to mate, thereby locking the components of the tool together.

A primary object of the present invention is to provide a cementing staging tool which is manipulated by the upper casing string to open and thereafter close a lateral flow passageway in the tool.

Another object of the invention is to provide a cementing staging tool which need not be drilled after the cementing job has been completed.

A further object of this invention is to disclose and provide a cementing tool which is left downhole as part of a casing string after the casing has been cemented to the borehole.

A still further object of this invention is the provision of a tool which is run into a borehole as part of a casing string, and is manipulated by the upper casing string to laterally flow cement into the borehole annulus, and which avoids the necessity of being drilled after the cementing operation has been completed.

The above objects are attained in accordance with the present invention by the provision of both method and apparatus for cementing casing into a borehole in a manner which avoids the necessity of subsequently drilling through the tool.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
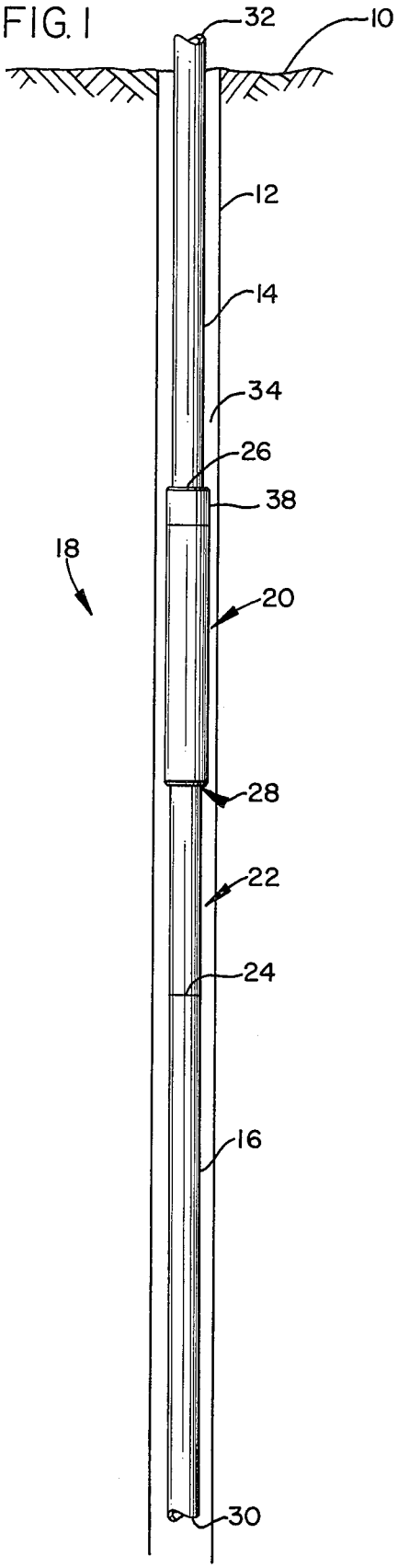
FIG. 1 diagrammatically illustrates the tool of the present invention disposed downhole in a borehole.

FIG. 1 diagrammatically discloses the surface 10 of the ground through which a borehole 12 has been formed, and within which there is disposed a tool string comprised of an upper casing string 14 and a lower casing string 16. Numeral 18 broadly indicates a cementing tool made in accordance with the present invention, which connects together the upper and lower casing string.

The tool of the present invention is comprised of an upper member 20 which is operatively connected to a lower member 22. Numeral 24 indicates the lower extremity of the tool, while numeral 26 indicates the upper extremity thereof. Numeral 28 indicates an interface formed between the upper and lower members. Numerals 30 and 32, respectively, indicate the lower and upper extremity, respectively, of the casing. The borehole annulus 34 is formed between the exterior of the casing and the wall of the open borehole.

Figure 2:
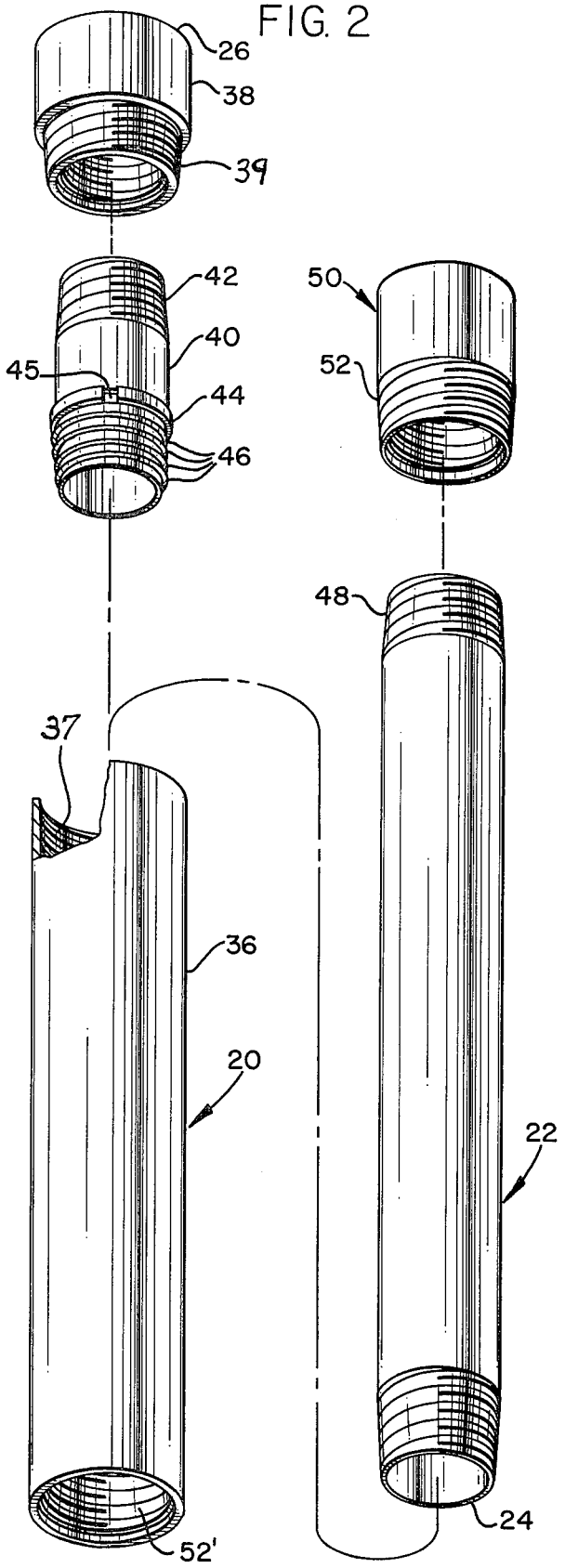
FIG. 2 is an enlarged, exploded view of part of the apparatus disclosed in FIG. 1.

As seen illustrated in FIG. 2, in conjunction with FIGS. 1 and 3–5, the upper member of the tool includes a barrel 36 which threadedly engages a sub 38 by means of the illustrated threads 37 and 39. A sleeve 40 is provided with an external threaded surface 42 which threadedly engages the lower internal threaded surface of the sub. Split snap ring 44 is received within a circumferentially extending groove 45 formed about the external marginal surface of the sleeve. A seal means is formed at the lower marginal end of the sleeve and is comprised of a plurality of O-rings 46 fitted within a series of spaced O-ring grooves.

The lower member 22 is in the form of a hollow, cylindrical mandrel having an external thread 48 formed at the upper marginal end thereof which threadedly engages complementary threads formed on the lower marginal interior surface of a hollow receptacle 50. The receptacle has a circumferentially extending inside peripheral wall surface 47. A threaded external surface 52 is formed at the lower marginal end of the hollow receptacle which threadedly engages a complementary threaded surface 52' formed on the lower, internal, marginal end of the barrel.

Figure 3:
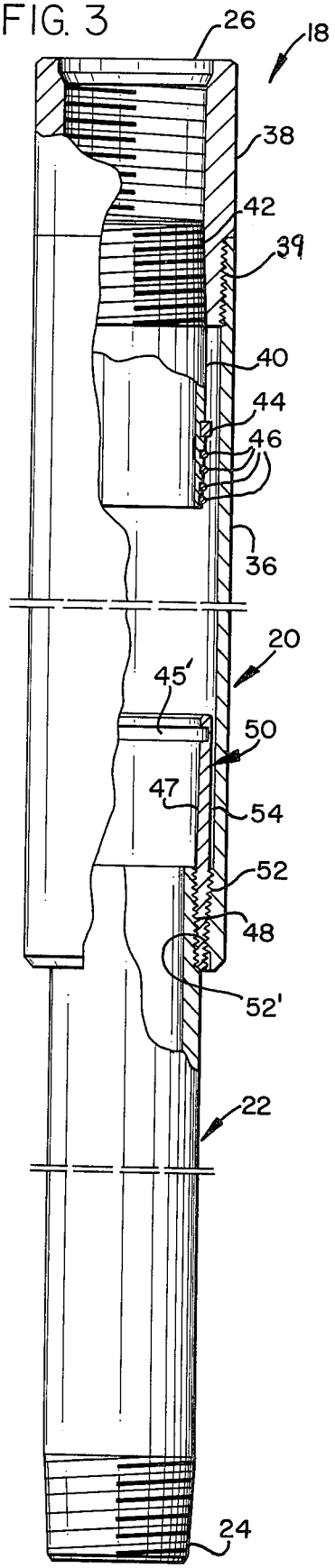
FIG. 3 is an enlarged, fragmented, part cross-sectional view of the tool disclosed in FIG. 2.

FIG. 3 illustrates the above embodiment of the tool of the present invention assembled in the running-in configuration, as broadly disclosed in FIG. 1. The sleeve 40 is seen to be spaced from the receptacle 50 with the threads 52 and 52' being engaged with one another. Hence, the tool of FIG. 3 provides a sealed flow path from the upper into the lower casing string.

Figure 4:
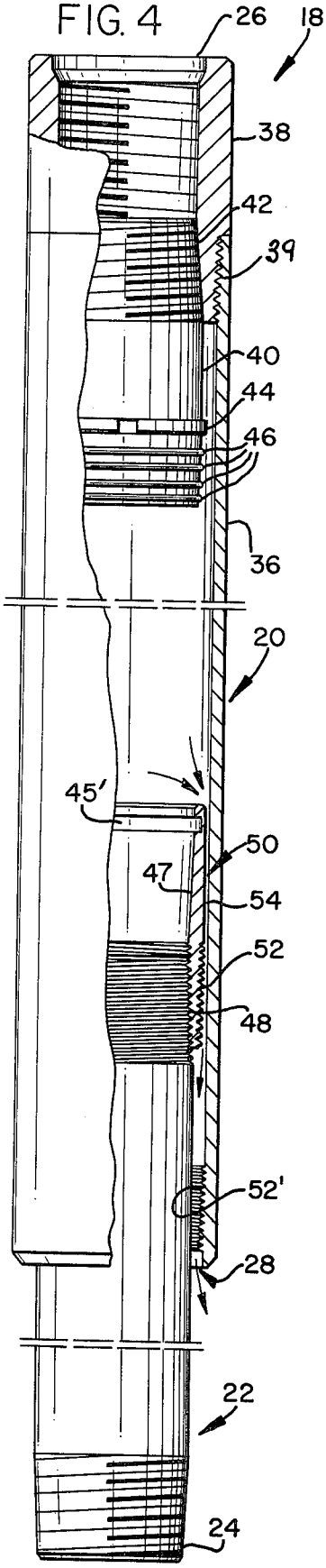
FIGS. 4 and 5 are similar to the view illustrated in FIG. 3 and show the tool of the present invention in various dif ferent operative configurations.

FIG. 4 illustrates the tool of FIGS. 1–3 in the alternate configuration, wherein the tool has been manipulated so that cement can be pumped down the upper string and laterally out into the borehole annulus.

As seen in FIG. 4, threads 52, 52' have been parted by rotating the upper member or barrel 20 respective to lower member or mandrel 22 by imparting rotational motion into the upper casing string. After threads 52, 52' have parted, the upper string is lowered, thereby moving the barrel in a downward direction so that flow can occur from the interior of the tool, through the newly opened annulus 54, where the flow exits the tool at 28 and flows out into the borehole annulus. Hence, the tool of FIG. 4 is in the cementing or operative configuration.

Figure 5:
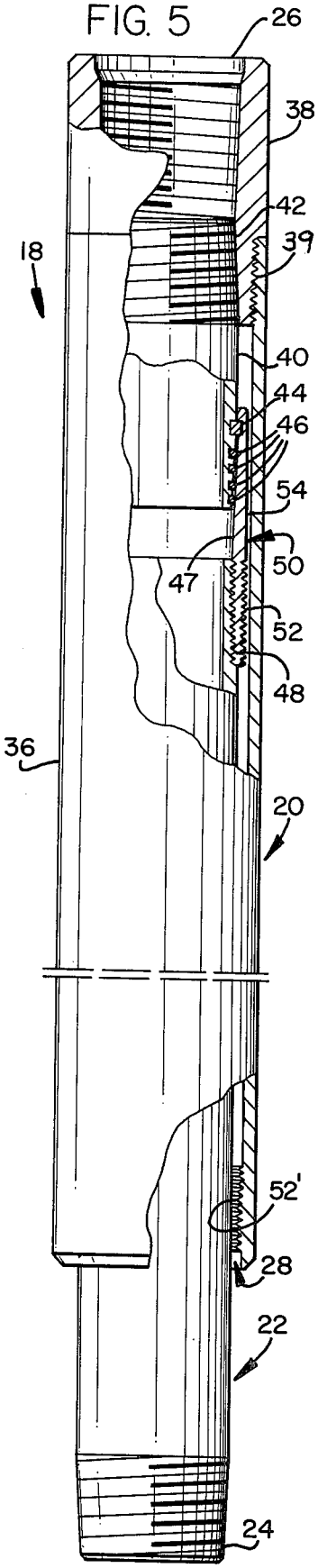

FIG. 5 illustrates the tool after it has been latched into the completed configuration. As seen in FIG. 5, the sleeve 40 has been lowered so that the snap ring 44 has been forced into the groove 45', thereby latching the receptacle and the sleeve together. At the same time, seal means 46 sealingly engage the slightly outwardly tapered wall 47 of the receptacle so that flow from the interior of the tool into the annulus 54 is precluded.

In operation, the tool 18 is assembled in the run-in configuration of FIG. 3. The tool is then series connected within the upper and lower casing strings and positioned downhole in the borehole at a predetermined elevation. A limited quantity of cement is pumped through the entire tool string where a plug of cement is formed about the casing in proximity of lower end 30. After an interval of time during which the plug "sets", the upper string 14 is rotated clockwise, thereby screwing threads 52 and 52' apart, whereupon the upper string and barrel can be lowered a few inches into the cementing or operative configuration of FIG. 4.

Cement is again pumped down the upper casing string and into the interior of the tool. From the interior of the tool, the cement is forced along the newly opened annulus 54 and emerges at 28 and fills the borehole annulus 34. Often the pumping of cement will continue until the cementatious material surfaces at 10.

Before the borehole annulus is completely filled with cement, water is generally pumped into the upper casing string so that the interior of the casing is flushed clean of cement, and a savings in money is effected.

Before the cement hardens, the upper casing string is again lowered to effect relative motion between the barrel and the mandrel so that the lower marginal end of sleeve 40 is received within receptacle 50. This action causes the tool to assume the configuration illustrated in FIG. 5 wherein the snap ring 44 is received within groove 45', with the multiple seal means 46 sealingly engaging the inside peripheral surface 47 of the receptacle. This action permanently closes the annular passageway 54 so that lateral flow can no longer occur therefrom.

The first embodiment of the invention disclosed in FIGS. 2–5 provides a positive means by which a casing can be cemented within a borehole by merely manipulating the upper casing string. Since the cementing tool of the present invention is hollow and provided with a minimum inside diameter equivalent to the nominal inside diameter of the casing string, there is no need to drill out the interior of the tool.

The presence of the barrel provides a guide means at 28 with respect to the mandrel 22 for proper alignment of the latch means. Moreover, there is never any danger of the casing being parted, because the two adjacent ends of the casings are always tied together in a positive manner by the tool of the present invention. The snap ring and the groove provide a latch means which is dependable and of adequate strength to prevent the upper and lower casing string from parting.

Where deemed desirable, the upper sub 38 and sleeve 40 can be fabricated as a unitary member. Likewise, the receptacle 50 and mandrel 22 can be fabricated as a unitary member if desired. The annulus 54 can be enlarged by changing the relative diameters of the remaining components of the tool to effect a cross-sectional area or annulus as may be desired.

Figure 6:
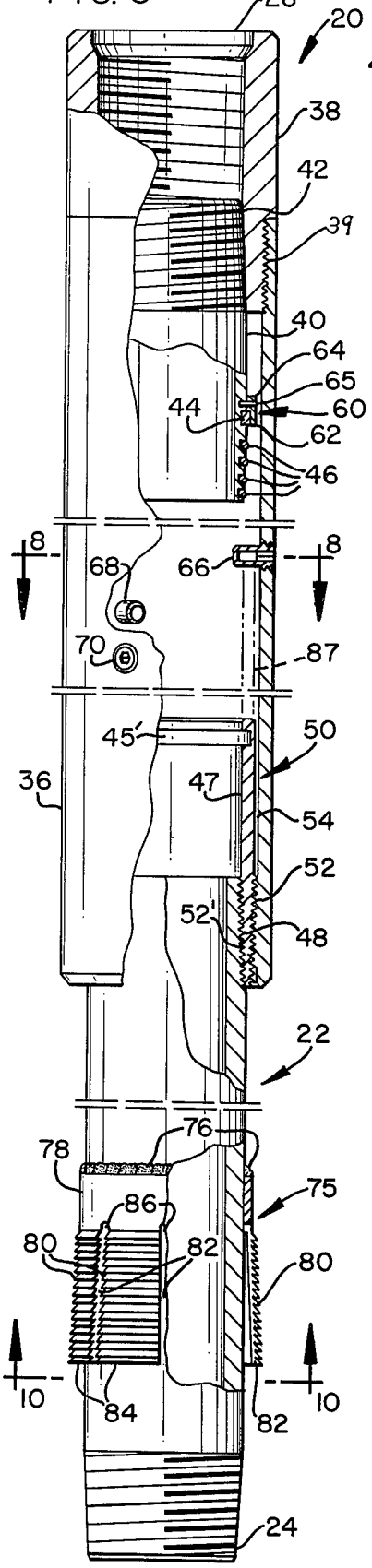
FIG. 6 is a fragmented, part cross-sectional view of another embodiment of a tool made in accordance with the present invention.
Figure 7:
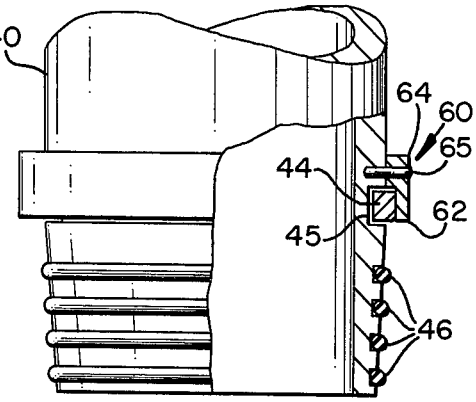
FIG. 7 is an enlarged, fragmented, part cross-sectional view of part of the apparatus disclosed in FIG. 6.
Figure 8:
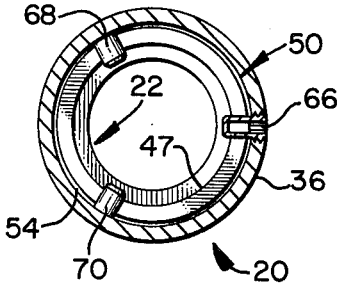
FIG. 8 is a cross-sectional view taken along line 8—8 of FIG. 6.
Figure 10:
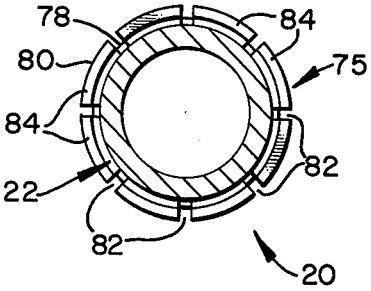
FIG. 10 is a cross-sectional view taken along line 10—10 of FIG. 6.

In the embodiment of the invention disclosed in FIGS. 6–10, the snap ring 44 is caged in compressed configuration by a cage assembly generally indicated by the numeral 60. As seen in the detail of FIG. 7, the cage includes a downwardly directed skirt 62 which enlarges into a shoulder at 64 so that the assembly can more or less encapsulate and force the split ring 44 back up into its groove 45. Shear pin 65 prevents inadvertent movement of the cage assembly.

As the barrel moves downward relative to the mandrel, the upper terminal end of the receptacle engages the skirt of the cage at 62, thereby shearing pin 65 and forcing the cage to slide up the sleeve. This action releases snap ring 44 as it slidably enters the interior of the hollow receptacle.

A plurality of radially spaced-apart, frangible plugs 66, 68, and 70 threadedly engage the sidewall of the barrel. The plugs are hollow and when the closed interior end thereof is broken, the interior of the barrel is placed in direct communication with the borehole annulus, thereby providing a lateral passageway from the interior of the tool into the borehole annulus.

Numeral 75 broadly illustrates a positive latch means which is utilized in this embodiment of the invention to augment the latch action of the ring 44 and groove 45'. The positive latch 75 is affixed at 76 to the mandrel by welding. The latch includes a continuous, circumferentially extending skirt portion 78 having a threaded surface 80 formed thereon. The threaded surface is provided with a plurality of radially spaced-apart, parallel slots 82, which extend from the lower edge 84, up through the threads, where the slots terminate within the skirt 78. The slots 82 impart the individual, elongated, tab-like members with resiliency so that the individual members can be sprung inwardly toward the mandrel. The threaded surface 80 is made complementary with respect to the threaded surface 52'; and therefore, when the tool is manipulated into the completed configuration of FIG. 9, the tab-like members are sprung inwardly so that the assembly 75 is forced to be telescopingly received by the threaded lower marginal end of the barrel. Accordingly, when the upper casing string is set down, latch 44 engages groove 45', and at the same time, latch member 75 is slidably received in a forceful manner into the lower marginal end of the barrel, thereby causing the tool to assume the configuration illustrated in FIG. 9.

In operation, the tool is placed in the running-in configuration of FIG. 6 and run downhole into the borehole in the before described manner. The tool is rotated and manipulated into the configuration described in conjunction with FIG. 4 of the drawings. This action causes the upper terminal end of the receptacle to engage and break the closed ends of the plugs 66, 68, 70 which fall to the bottom of the borehole. Shearing of the plugs provides a plurality of radially spaced ports which form a lateral flow passageway in the barrel in addition to the formation of the annulus at 54 through which fluid can flow from the interior of the tool laterally out into the borehole annulus.

Figure 9:
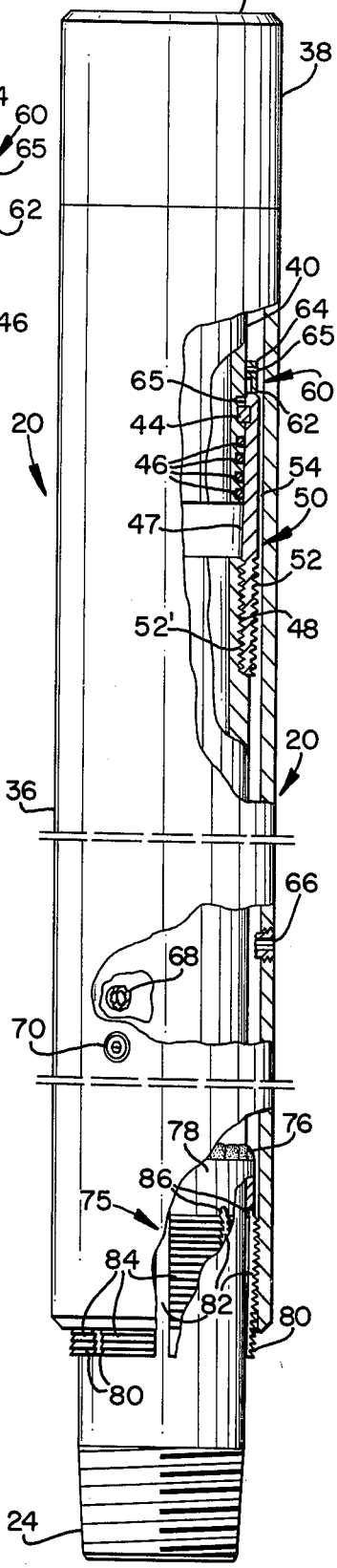
FIG. 9 discloses the tool of FIG. 6 in a different operative configuration.

After the borehole annulus is filled with cement, the upper string is lowered so that the tool assumes the configuration illustrated in FIG. 9. As the seal means of the sleeve 40 is received within the receptacle, the upper terminal end of the receptacle engages the skirt 62 of the cage assembly, thereby shearing pins 65 and forcing the cage to move in an upward direction in the illustrated manner of FIG. 9. This expedient enhances the locking action by assuring that the split ring 44 is positively received within the groove 45' of the receptacle.

As the tool approaches the configuration illustrated in FIG. 9, the positive latch means 75 is forced to ride in high friction relationship across the threads 52 of the barrel until the threads mutually engage one another in the illustrated manner of FIG. 9. It will be noted that the threads 80 are sloped in a downward direction, thereby providing minimum friction as the member 75 is forced to slide up into the barrel. At the same time, the threads are downwardly sloped so that a maximum of friction is developed when the upper and lower members are placed in tension respective to one another.

Figure 11:
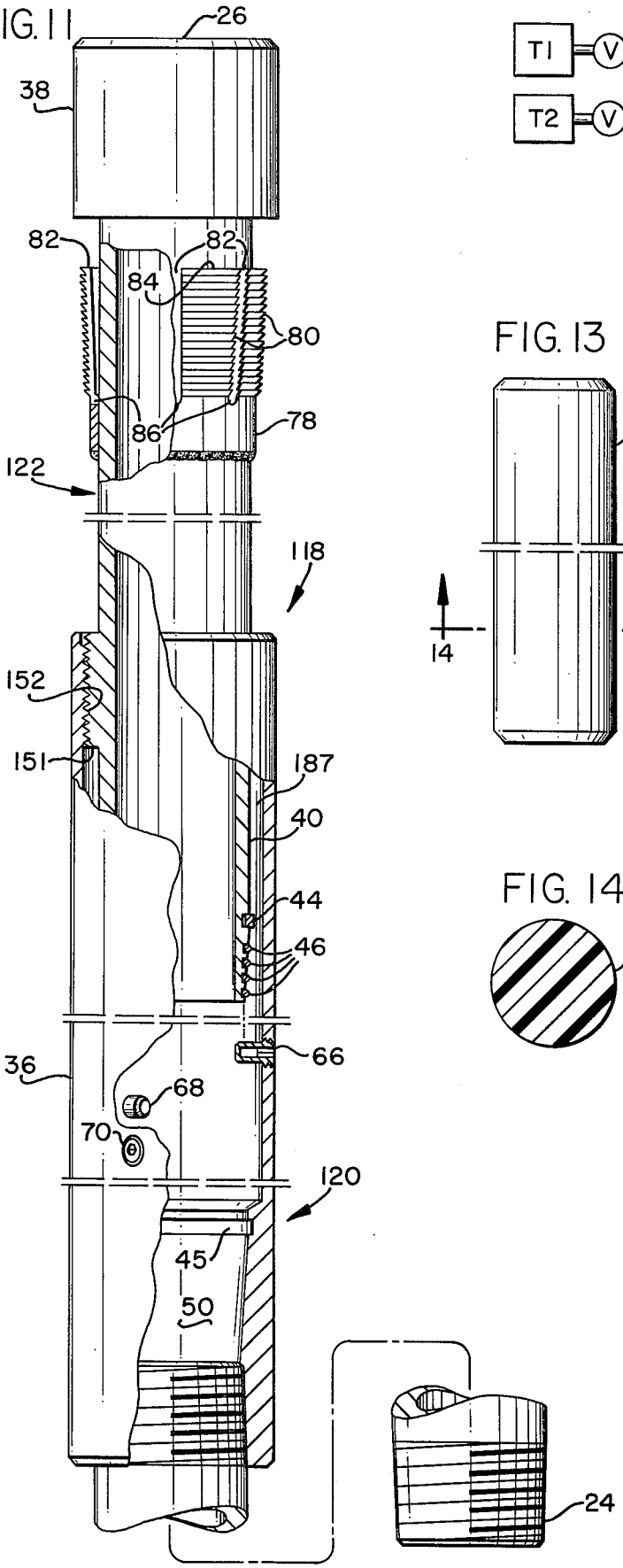
FIG. 11 is a fragmented, part cross-sectional view of another embodiment of a tool made in accordance with the present invention.

In the embodiment of the invention disclosed in FIG. 11, the positive latch means is attached to the mandrel in overlying, concentric relationship respective to the barrel. The upper marginal end of the barrel threadedly engages the mandrel at 152 so that the mandrel may be rotated respective to the barrel in order to disengage the threads at 152 from one another.

The lower end of the sleeve engages and breaks the closed end of the plugs 66, 68, and 70 as the tool is lowered into the cementing configuration. Annulus 187 can be made of any desired cross-sectional area, depending upon the relative diameters of the components of the tool and the minimum and maximum inside diameters available for selection. Where deemed desirable, the plugs 66–70 can be made shorter and located within annulus 187 so as to preclude breakage thereof should it be necessary to run various tools downhole through the tool string of the invention. In this instance, shoulder 151 will engage and break the closed ends of the plugs.

In FIG. 11, the seal means 46 is received in seated relationship against the tapered, internal peripheral wall surface of the receptacle similar to the before described embodiments.

Figure 12:
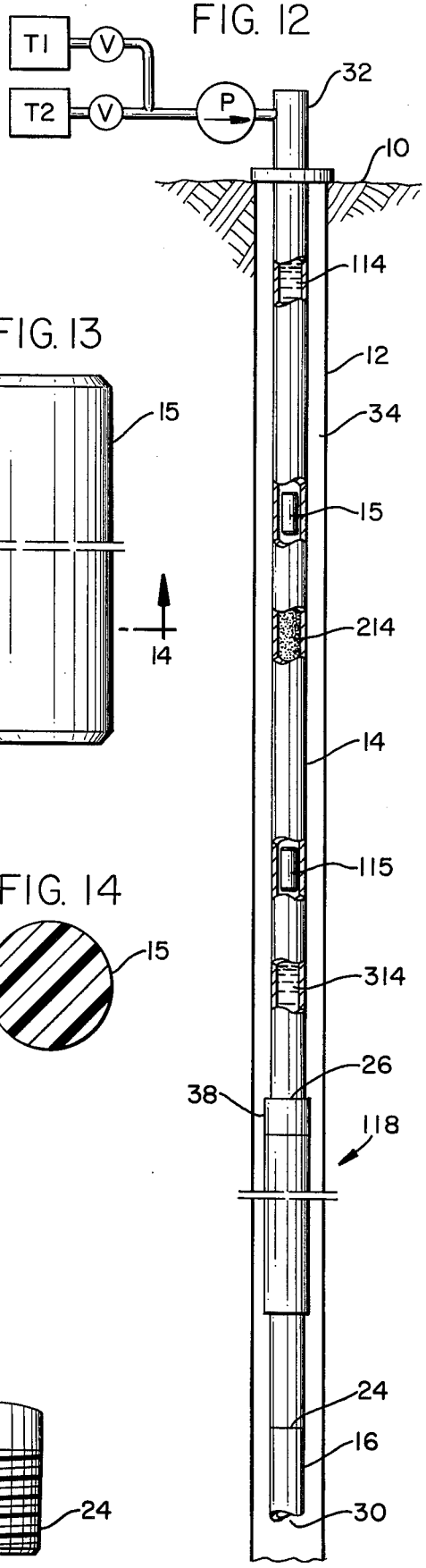
FIG. 12 discloses a method of cementing a borehole in accordance with the present invention.
Figure 13:
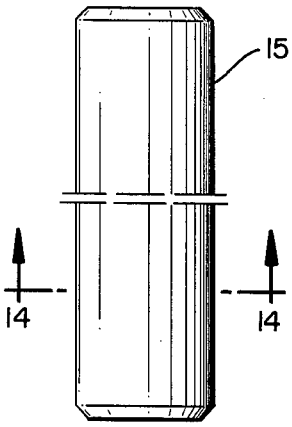
FIG. 13 is an enlarged, elevational view of part of the apparatus disclosed in FIG. 12; and, FIG. 14 is a cross-sectional view taken along line 14—14 of FIG. 13.
Figure 14:
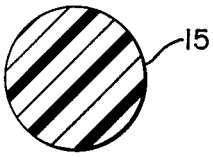

In the embodiment of the invention illustrated in FIGS. 12–14, spaced plugs 15 and 115 are pumped down the casing string by means of the illustrated pump. The suction side of the pump is flow connected to tanks T1 and T2, which generally will contain a source of cement and a source of water. The interior of the casing at 114 contains a column of water which is separated from a column of cement 214 by means of plug 15. The cement 214 is separated from a column of oil at 314 by means of a plug 115.

As seen in FIGS. 13 and 14, the plug 15 or 115 is of a diameter which conforms the inside diameter of the casing. The plug 15 is made of a substance such as soap which is solubilized by the water 114 after a few hours. The plug 115 is made of a substance such as wax which is solubilized by the hydrocarbons at 314 after a few hours.

Accordingly, in carrying out this aspect of the invention, after the tool string has been run downhole into the borehole, the plug 115 is placed within the upper end of the casing and forced down to the bottom of the tool 118, thereby maintaining the column of cement separated from the fluid column of the hydrocarbons. The plug 115 eventually is solubilized by the hydrocarbons so that it offers no subsequent problems.

Toward the end of the cementing operation, when it is desired to force the remaining cement out of the interior of the casing, the plug 15 is interposed between the column of cement and a column of water 114. The water is utilized to force the plug 15 down into the tool. This action maintains the water column and the mass of cement separated from one another and further, reduces the amount of cement left behind on the interior wall surface of the casing.

The cementing tool of the present invention can be series connected into a string of casing 14 and 16 and used for cementing the casing string within a borehole 12 by flowing cement down the string 14, into the tool 18, and into the borehole annulus 34.

The tool includes a sub 38, a mandrel 22, a barrel 36, a sleeve 40, a receptacle 50, all concentrically arranged respective to one another along a common central axis as in the before described manner. The barrel has opposed ends with one marginal end being affixed to the sub 38 and the remaining marginal end being affixed to the mandrel 22.

The threads 52, 52' provide means by which one marginal end of the barrel can be disengaged from the mandrel to enable the mandrel to be moved axially towards the sub. The sleeve is affixed to either the sub or the mandrel, while the receptacle is affixed to either the barrel or the sub. The barrel has a threaded surface which is disengaged to permit the mandrel and barrel to move axially towards one another, whereupon the sleeve is received within the receptacle in the illustrated manner of FIGS. 5 and 9, for example.

Latch means 44 and 45 are provided by which the sleeve is locked in sealed relationship respective to the receptacle when the mandrel is moved longitudinally respective to the sub.

A secondary latching means 75 is provided for engagement with one of the before mentioned threads so that as the sleeve is locked in sealed relationship respective to the receptacle, the secondary positive latching means likewise is permanently attached to the recited threaded surface.

The sleeve and receptacle are hollow and form an axial flow path through the tool, while the annulus located between the barrel and mandrel form a lateral flow path from the tool.

I claim:

1. A cementing tool which requires no drill-out after staging and which is permanently series connected into a string of casing for cementing the entire casing string within a borehole by flowing cement down the upper casing string, axially through the tool, and down through the lower casing string; and, thereafter down through the upper string, laterally through the tool, and directly into the borehole annulus, comprising:

said tool includes a sub at the upper end thereof for connecting the tool to the lower end of the upper casing string; a barrel affixed to said sub;

a mandrel having a lower end for connecting the tool to the upper end of the lower casing string, the upper marginal end of said mandrel being telescopingly received within said barrel with there being an annulus formed therebetween; means by which the mandrel releasably engages the lower end of the barrel in sealed relation therewith and is captured therewithin so that the mandrel and barrel are always attached to one another;

a fluid conducting sealed latch means having one end connected to said sub and another end which can be sealingly connected to said mandrel when the sub is moved towards the mandrel; said sub, barrel, mandrel, and fluid conducting sealed latch means being concentrically arranged respective to one another; whereby, said tool is connected in series relation within a string of casing and lowered into a borehole, cement is pumped through the entire casing string, including the tool, thereby carrying out a first cementing operation, and the upper end of the mandrel is next released from the lower end of the barrel and moved towards the sub to thereby open the annulus between the mandrel and the barrel so that cement can flow laterally away from the tool and into the borehole annulus, and said tool is thereafter again latched together to close the lateral flow path by moving the sub towards the mandrel to cause the sealed latch means to engage one another.

2. The tool of claim 1 wherein said latch means includes a receptacle and a sleeve said receptacle is affixed to one end of said mandrel and is received within said barrel; said sleeve is affixed to said sub and is received within said barrel, said sleeve having an external, circumferentially extending groove formed thereabout, a snap ring captured within said groove;

means forming a groove within said receptacle for receiving said snap ring therein; seal means formed between said receptacle and said sleeve so that when said sleeve is received within said receptacle, said ring mutually engages each of said grooves, and said seal means seals said receptacle and sleeve to one another.

3. The tool of claim 1 wherein said latch means includes a receptacle and a sleeve; said barrel and said mandrel are of a relative diameter to form an annulus therebetween when they are telescoped into a first position to thereby enable fluid to be pumped therethrough, and said barrel and said mandrel are thereafter telescoped into a second position to latch said sleeve and receptacle together to preclude fluid flow through said annulus.

4. The tool of claim 3 and further including a second latch assembly, said second latch assembly is a skirt having a circumferentially threaded surface made complementary with the first recited threads of said barrel, said skirt being affixed to said mandrel in spaced relationship to said receptacle, said skirt is slidably received in a telescoping manner within the threaded barrel when the tool is moved into the second position.

5. The tool of claim 1 wherein said latch means includes a receptacle and a sleeve, and further including a skirt attached to said mandrel in spaced relationship to said threaded surface thereof, said skirt having circumferentially extending teeth thereon made complementary respective to said threaded surface of said barrel, means by which said skirt can be resistingly, inwardly moved sufficiently to cause the skirt to be telescopingly received within said threaded surface of said barrel simultaneously with said sleeve being engaged within said receptacle.

6. The tool of claim 1 wherein said latch means includes a receptacle and a sleeve; wherein said receptacle is affixed to one end of said mandrel and positioned within said barrel; said sleeve is affixed to said sub and positioned within said barrel, said sleeve having an external, circumferentially extending groove formed thereabout, a snap ring captured within said groove;

means forming a groove within said receptacle for receiving said snap ring therein; seal means formed between said receptacle and said sleeve so that when said sleeve is received within said receptacle, said ring mutually engages each of said grooves with said seal means sealing said receptacle and said sleeve together;

and further including a second latch assembly spaced from said latch means, and including a skirt attached to said mandrel in spaced relationship to said threaded surface thereof, said skirt having circumferentially extending teeth thereon made complementary respective to said threaded surface of said barrel, means by which said skirt can be resistingly, inwardly moved sufficiently to cause the skirt to be telescopingly received within said threaded surface of said barrel simultaneously with said sleeve being engaged within said receptacle.

7. The tool of claim 6 and further including a frangible plug positioned in the sidewall of said barrel and radially, inwardly directed towards the axial centerline thereof so that said receptacle engages and breaks the plug, thereby effecting a port which extends through the sidewall of the barrel and permits flow to occur laterally away from said tool.

8. The tool of claim 1 and further including a frangible plug positioned in the sidewall of said barrel and radially, inwardly directed towards the axial centerline thereof so that said receptacle engages and breaks the plug, thereby effecting a port which extends through the sidewall of the barrel and permits flow to occur laterally away from said tool.

9. A cement staging tool for permanent connection into a casing string which establishes an axial flow path for flow of cement therethrough and thereafter enables a lateral flow path to be established for flow of cement therethrough, comprising:

a sub, a mandrel, a barrel, a sleeve, a receptacle; said barrel having opposed ends with one marginal end being connected to said sub and the remaining marginal end being removably affixed to said mandrel;

means by which said affixed marginal end of said barrel can be disengaged from said mandrel to enable the mandrel to be moved axially towards said sub; there being an annular flow path formed between the mandrel and the barrel;

said sleeve being affixed to one of said sub and mandrel, said receptacle being affixed to the remaining one of said sub and mandrel in spaced relation to said sleeve; such that said barrel can be disengaged from said mandrel to permit said mandrel to move axially towards said sub whereupon said sleeve is received within said receptacle;

means including a latch by which said sleeve is locked in sealed relationship to said receptacle when said mandrel is moved axially towards said sub;

whereby fluid can be pumped down through the tool and out of the lower end of the string, the affixed marginal end of said barrel can be disengaged and the sleeve moved relative to said receptacle, thereby forming an annular flow path through which flow can occur laterally through the tool;

and thereafter the sleeve and receptacle can be moved together whereupon they become locked together and form an axial flow path through the tool.

10. A cementing tool for permanent connection into a casing string which does not require subsequent drilling and which enables cement to be pumped through the entire casing string, and thereafter laterally through the tool and directly into the borehole annulus, and thereafter said lateral flow is sealed off so that only an axial flow path extends through the entire casing string; said tool comprising:

a sub, a barrel, and a mandrel concentrically arranged respectively to one another along a common axial centerline;

said mandrel and sub being spaced from one another and affixed to opposed marginal ends of said barrel; means by which a marginal end of said mandrel is always located within a marginal end of said barrel;

a sleeve, a receptacle for sealingly receiving said sleeve therein, lock means by which said sleeve is locked to said receptacle when the sleeve is sealingly engaged therewith;

means mounting said sleeve adjacent one said opposed end of said barrel, means mounting said receptacle adjacent the other opposed end of the barrel, said sleeve being spaced from said barrel to form an annulus therebetween, said receptacle being received about said sleeve and within said annulus when the sleeve and receptacle are moved into engagement with one another;

means by which said mandrel can be disengaged from said barrel and telescopingly moved into said barrel while an annular flow path is formed between said mandrel and barrel so that a lateral flow path is formed which extends from the interior of the tool into the borehole annulus;

so that said mandrel can again be moved further into said barrel to cause said sleeve to be received in sealed and locked relationship within said receptacle; thereby closing said lateral flow path and leaving said axial flow path through the tool.

11. A tool for cementing casing within a well bore comprising a stationary and a movable hollow member, said tool includes upper and lower marginal ends for permanent connection into a string of casing so that fluid can flow through the upper marginal length of the casing, into said upper end, through the tool, out of said lower end, and through the lower marginal length of the casing;

said movable and stationary members being concentrically arranged and threadedly secured to one another; means by which one of said members can be unthreaded from the other and the two members telescoped together while said members are captured together;

a hollow sleeve affixed to one said member in axial alignment therewith and spaced from the outermost of said members to form an annulus therebetween; a receptacle affixed to the other of said members in axial alignment therewith; seal means and latch means by which said sleeve is sealingly locked into said receptacle when said members are telescoped together, thereby forming a sealed axial flow path through the tool;

means forming a lateral flow passageway from the interior of the tool when one member is partially telescoped into the second member;

whereby, said upper and lower members can be unscrewed to form said lateral flow passageway, and thereafter latched together to eliminate said lateral flow passageway.

12. The tool of claim 11 wherein said receptacle is affixed to one end of said mandrel and is received within said barrel; said sleeve is affixed to said sub and is received within said barrel, said sleeve having an external, circumferentially extending groove formed thereabout, a snap ring captured within said groove;

means forming a groove within said receptable for receiving said snap ring therein; seal means formed between said receptable and said sleeve so that when said sleeve is received within said receptacle, said ring mutually engages each of said grooves, and said seal means seals said receptacle and sleeve to one another.

13. The tool of claim 11 wherein said barrel and said mandrel are of a relative diameter to form an annulus therebetween when they are telescoped into a first position to thereby enable fluid to be pumped therethrough, and said barrel and said mandrel are thereafter telescoped into a second position to latch said sleeve and receptacle together to preclude fluid flow through said annulus.

14. The tool of claim 13 wherein there is included a second latch assembly, said second latch assembly is a skirt having a circumferentially threaded surface made complementary with the first recited threads of said barrel, said skirt being affixed to said mandrel in spaced relationship to said receptical, said skirt is slidably received in a telescoping manner within the threaded barrel when the tool is moved into the second position.

15. The tool of claim 11 and further including a skirt attached to said mandrel in spaced relationship to said threaded surface thereof, said skirt having circumferentially extending teeth thereon made complementary respective to said threaded surface of said barrel, means by which said skirt can be resistingly, inwardly moved sufficiently to cause the skirt to be telescopingly received within said threaded surface of said barrel simultaneously with said sleeve being engaged within said receptacle.

16. The tool of claim 11 and further including a frangible plug positioned in the sidewall of said barrel and radially inwardly directed towards the axial centerline thereof so that said receptacle engages and breaks the plug, thereby effecting a port which extends through the sidewall of the barrel and permits flow to occur laterally away from said tool.

17. A cementing tool which can be series connected into a string of casing for cementing the casing string in stages within a borehole by flowing cement down the upper string and axially through the tool to the bottom of the borehole and thereafter laterally from the tool and directly into the borehole annulus, comprising:

a sub; a sealed, fluid-conducting latch means; a mandrel, and a barrel;

said latch means includes a receptacle and a sleeve which latchably engage one another in sealed relationship thereto and form a hollow flow conduit;

said mandrel and said sub having opposed marginal ends by which said tool can be connected in series relationship within a string of casing;

said barrel having opposed ends with one end being connected to said sub and the other to said mandrel such that said mandrel, barrel, and sub are concentrically arranged respective to one another;

a threaded exterior surface formed on a marginal length of said mandrel, another threaded surface formed on a marginal length of said barrel; the last two recited threaded surfaces threadedly engaging one another;

means mounting said latch means within said barrel such that said receptacle and said sleeve are disposed in spaced relationship respective to one another, with said receptacle being affixed to one of said barrel and mandrel and said sleeve being affixed to the remaining of said barrel and mandrel;

said barrel can be rotated respective to said mandrel to unthread said threaded surfaces, and said mandrel can be telescoped into said barrel whereupon said sleeve is engaged in sealed relationship to said receptacle;

and further including a skirt attached to said mandrel in spaced relationship to said threaded surface thereof, said skirt having circumferentially extending teeth thereon made complementary respective to said threaded surface of said barrel, means by which said skirt can be resistingly, inwardly moved sufficiently to cause the skirt to be telescopingly received within said threaded surface of said barrel simultaneously with said sleeve being engaged within said receptacle.

18. A cementing tool which can be series connected into a string of casing for cementing the casing string within a borehole by flowing cement down the upper string and through the tool into the borehole annulus, comprising:

a sub, a sealed, fluid-conducting latch means; a mandrel, and a barrel;

said latch means includes a receptacle and a sleeve which latchably engage one another in sealed relationship thereto and form a hollow flow conduit;

said mandrel and said sub having opposed marginal ends by which said tool can be connected in series relationship within a string of casing;

said barrel having opposed ends which are connected to said sub and to said mandrel such that said mandrel, barrel, and sub are concentrically arranged respective to one another;

a threaded surface formed on a marginal exterior length of said mandrel and a marginal interior length of said barrel; the last two recited threaded surfaces threadedly engaging one another;

means mounting said latch means within said barrel such that said receptacle and said sleeve are disposed in spaced relationship respective to one another, with said receptacle being affixed to one of said barrel and mandrel and said sleeve being affixed to the other of said barrel and mandrel;

means by which said barrel can be rotated respective to said mandrel to unthread said threaded surfaces, and said mandrel can be telescoped into said barrel whereupon said sleeve is engaged in sealed relationship to said receptacle;

and further including a frangible plug positioned in the sidewall of said barrel and radially, inwardly directed towards the axial centerline thereof so that said receptacle engages and breaks the plug, thereby effecting a port which extends through the sidewall of the barrel and permits flow to occur laterally away from said tool.

* * * * *

UNITED STATES PATENT OFFICE

CERTIFICATE OF CORRECTION

Patent No. 4,105,074 Dated August 8, 1978

Inventor(s) ERNEST E. ARMSTRONG

It is certified that error appears in the above-identified patent and that said Letters Patent are hereby corrected as shown below:

Column 7, line 40, substitute --relationship-- for "relation".

Column 7, line 50, substitute --relationship-- for "relation".

Column 9, line 5, after "that" insert "one end of" and substitute --sealed latch means-- for "receptacle".

Column 9, line 20, substitute --remaining-- for "affixed".

Signed and Sealed this

*Tenth* Day of *April 1979*

[SEAL]

*Attest:*

RUTH C. MASON
*Attesting Officer*

DONALD W. BANNER
*Commissioner of Patents and Trademarks*